US007828917B2

(12) United States Patent
Onodera et al.

(10) Patent No.: US 7,828,917 B2
(45) Date of Patent: Nov. 9, 2010

(54) RAIL MANUFACTURING METHOD

(75) Inventors: Noriaki Onodera, Kitakyushu (JP); Takuya Satoh, Kitakyushu (JP); Masaharu Ueda, Kitakyushu (JP); Kazuo Fujita, Kitakyushu (JP); Akira Kobayashi, Kitakyushu (JP)

(73) Assignee: Nippon Steel Corporation, Chiyoda-ku, Yokyo (JP)

( * ) Notice: Subject to any disclaimer, the term of this patent is extended or adjusted under 35 U.S.C. 154(b) by 494 days.

(21) Appl. No.: 10/585,472

(22) PCT Filed: Jan. 7, 2005

(86) PCT No.: PCT/JP2005/000427

§ 371 (c)(1),
(2), (4) Date: Jul. 6, 2006

(87) PCT Pub. No.: WO2005/066377

PCT Pub. Date: Jul. 21, 2005

(65) Prior Publication Data

US 2009/0014099 A1 Jan. 15, 2009

(51) Int. Cl.
*C21D 9/04* (2006.01)
*C21D 9/06* (2006.01)

(52) U.S. Cl. ..... 148/584; 148/580; 148/585; 148/645; 148/646

(58) Field of Classification Search ..... 148/581, 148/646, 584, 585, 580, 645
See application file for complete search history.

(56) References Cited

U.S. PATENT DOCUMENTS

| | | | | |
|---|---|---|---|---|
| 1,456,944 | A * | 5/1923 | Stenbol | 148/585 |
| 3,276,924 | A | 10/1966 | Okamoto et al. | |
| 6,224,694 | B1 | 5/2001 | Prskawetz et al. | |
| 6,432,230 | B1 * | 8/2002 | Kock et al. | 148/646 |

FOREIGN PATENT DOCUMENTS

| | | | |
|---|---|---|---|
| JP | 55002768 | * | 1/1980 |
| JP | 59031824 | * | 2/1984 |
| JP | 60251221 | * | 12/1985 |
| JP | 62013528 | * | 1/1987 |
| JP | 63-114923 | * | 5/1988 |
| JP | 03-166318 | | 7/1991 |
| JP | 05076921 | * | 3/1993 |
| JP | 08295938 | * | 11/1996 |

(Continued)

OTHER PUBLICATIONS

Human—English translation of Japanese patent 59-031824, Gishi Takao et al., Feb. 21, 1984.*
Notice of Allowance issued Dec. 28, 2007, for corresponding Russian Patent Application No. 2006125717 and English—language translation thereof.

*Primary Examiner*—Deborah Yee
(74) *Attorney, Agent, or Firm*—Dorsey & Whitney LLP

(57) ABSTRACT

A rail manufacturing method is provided, in which a billet is hot-rolled into a rail form and the rail is cooled to ambient temperature. The foot part of the rail can be mechanically restrained to improve the straightness of the rail during at least the period of cooling where the surface temperature is between 800° C. and 400° C. In the subsequent cooling process, at least while the surface temperature of the foot of the rail is between 400° C. and 250° C., the rail is kept in an upright state, and cooled naturally without using insulation or accelerated cooling.

9 Claims, 1 Drawing Sheet

FOREIGN PATENT DOCUMENTS

| | | | |
|---|---|---|---|
| JP | 09168814 | * | 6/1997 |
| JP | 10130730 | * | 5/1998 |
| JP | 2003-129182 | | 5/2003 |
| JP | 2003160813 | * | 6/2003 |
| JP | 2003-207319 | | 7/2003 |
| RU | 2101369 | | 7/1995 |
| RU | 2128718 | | 4/1999 |

* cited by examiner

RAIL MANUFACTURING METHOD

CROSS REFERENCE TO RELATED APPLICATION(S)

This application is a national stage application of PCT Application No. PCT/JP2005/000427 which was filed Jan. 7, 2005 and published on Mar. 31, 2005 as International Publication No. WO 2005/066377 (the "International Application"), the entire disclosure of which is incorporated herein by reference. This application claims priority from the International Application pursuant to 35 U.S.C. §365. The present application also claims priority under 35 U.S.C. §119 from Japanese Patent Application No. 2004-004358, filed Jan. 9, 2004, the entire disclosure of which is incorporated herein by reference.

FIELD OF THE INVENTION

The present invention relates to a rail manufacturing method, and to a cooling method which reduces the bending which is generated after cooling the hot-rolled rail shape.

BACKGROUND INFORMATION

In general, rails for use in railroads are formed through heating the billet and hot-rolling it into a specific form, and then, after performing heat treatment according to the desired mechanical properties, it is cooled to ambient temperature. Then, after performing rectification, a specific examination can be performed and the rail becomes a final product. Heat treatment is performed as necessary, and there are instances where these operations may be omitted.

In the above-described rail manufacturing method, it is normal to perform the hot-rolling process while the rail is positioned laterally. When no heat treatment is performed, the rail is transported on its side to the cooling bed, where it is cooled.

However, as the cross-sectional shape of the rail is asymmetrical in the vertical direction when it is in the upright state, curvature can be generated in the height direction during the cooling process after hot-rolling (here, we refer to curvature in the vertical direction when the rail is upright as being bending in the height direction, and curvature in the lateral direction as being bending in the width direction). In normal operational methods, as the bending in the height direction may increase and it is easy for the rail to become unbalanced and topple over, this causes difficulties in the normal transport of the rail, in the placing of the rail on the cooling bed, and in the withdrawal of the rail from that bed. Therefore, from the view of trying to prevent this unbalanced state, in most of the above manufacturing processes, the rail is treated and transported on its side. However, when rapidly cooling the rail using air or mist, this cooling operation is performed on the rail when it is upright, but, as described in Japanese Unexamined Patent Application Publication S62-13528, it is common for the heat treatment to be performed on the rail in an upright state, and then, the rail is positioned laterally until it reaches the cooling bed.

When leaving the rail on its side and letting it cool in this manner (i.e., by allowing the heat to naturally dissipate without forcible cooling), it becomes easier for the rail to bend, as there are no constraints on the rail in the height direction. Further, as a temperature difference develops between the side surface of the rail which is closest to the cooling bed and the opposite side surface, bending can also occur in the width direction.

This type of rail curvature is rectified at the end of the manufacturing process whereby rails which have developed curvature being placed on a rectifier that has rollers arranged in a zig-zag shape, and undergoing a further press operation as necessary. However, as this rectification process can require a great deal of time if the amount of curvature is large, it can result in a reduction in productivity or an increase in manufacturing costs. Further, for rails to be used in the high-speed railroads which have been in demand recently, as these rails demand an especially high level of straightness, instances may arise where it is not possible to sufficiently rectify the curvature by press rectification, leading to a reduction in yield.

As methods of controlling curvature on the cooling bed, the following types of technology have been disclosed.

First, in Japanese Unexamined Patent Application Publication H05-076921, a method is described in which the high temperature rail is cooled on its side on the cooling bed, and both ends of the rail which is charged within the cooling bed are bent such that the head of the rail moves to the outer side of the bend. Further, in Japanese Unexamined Patent Application Publication H09-168814, a method is described in which a transfer and a stopper are used on the cooling bed to bend the lateral rail such that it will be straight after cooling.

However, in these methods, it may be difficult to adjust the degree of curvature and the shape of this curvature of both ends of the rail and, and it is not possible to rigorously control this curvature. Further, it may be difficult to control the curvature in the width direction of the rail.

In Japanese Unexamined Patent Application Publication S59-031824, a method is described in which curvature of the rail during the cooling process is prevented by setting the rail in an upright state, insulating the bottom part of the rail, and synchronizing the cooling speed of the foot of the rail with the cooling speed of the head of the rail. By this method, the curvature of the rail is reduced, but it is difficult to select insulation in order to synchronize the cooling speeds of the foot and head of the rail, and capital investments may increase. Further, the time required for cooling will likely grow due to this insulation in order to decrease the cooling speed, resulting in a decrease in productivity.

In addition, when performing the above type of insulation on multiple rails, if the cooling conditions for all of the rails are the same, then there is efficacy in straightening the rails, but if rails of differing sizes are mixed together in the cooling process, the cooling conditions for each rail may differ, resulting in rails for which the curvature is not reduced. Further, but as the time required for the cooling process will grow, ample time is allowed for expansion and contraction of the material to occur, leading to concerns that the amount of curvature may actually be increased.

SUMMARY OF EXEMPLARY EMBODIMENTS OF THE INVENTION

Exemplary embodiments of the present invention attempt to solve the above-described deficiencies of the prior art, and to provide a rail manufacturing method which is simple and in which it is possible to reduce the amount of curvature after cooling.

For example, the present invention provides a rail manufacturing method in which a billet is hot-rolled into a rail form, and where after hot-rolling the high-temperature rail is cooled to ambient temperature. In one exemplary embodiment of the rail manufacturing method, the rail can be maintained in an upright state until the surface temperature of the head of the rail reaches the 400° C. to 250° C. temperature range, and where the rail is cooled naturally without using insulation or accelerated cooling.

The billet may be hot-rolled into a rail form, and where after hot-rolling, the high-temperature rail is cooled to ambient temperature that is a rail manufacturing method. The rail may not only be maintained in an upright state until the surface temperature of the head of the rail reaches the 800° C. to 400° C. temperature range, but the foot of the rail may be mechanically restrained as well.

While mechanically restraining the foot of the rail and, at the same time, maintaining the rail in an upright state, it is preferable to perform accelerated cooling of the head and the foot of the rail at a speed of 1° C. per second to 20° C. per second at least until the surface temperature of the head of the rail reaches the 550° C. to 450° C. temperature range, or until the surface temperature of the foot of the rail reaches the 500° C. to 450° C. temperature range.

According to another exemplary embodiment of the present invention, it may be preferable to make the temperature of the surface of the head of the rail which begins the accelerated cooling or the temperature of the surface of the foot part of the rail which begins the accelerated cooling the temperature, where the structure of the rail is austenitic.

It may be preferable to maintain the rail after the hot-rolling in an upright state until it reaches ambient temperature. It may also be preferable to place the rail into an upright state after the hot-rolling during conveyance, and to measure the cross-sectional shape of the rail online. Further, it may be preferable for the length of the rail to be within 80 to 250 meters.

According to a further exemplary embodiment of the rail manufacturing method of the present invention, by naturally cooling the rail which is maintained in an upright state until the surface temperature of the head of the rail reaches the 400° C. to 250° C. temperature range without using insulation or accelerated cooling, it is possible to control the curvature of the rail in the vertical direction through the weight of the rail itself. As a result, it is possible to prevent curvature of the rail in the vertical direction without needing to perform deformation operations in advance to prevent conventional bending. Further, as neither edge of the rail comes into contact with the cooling bed, both sides release heat in the same way, and as there is no temperature gradient generated in the width direction of the rail (there is no temperature difference between the two side surfaces of the rail), it is possible to control the curvature of the rail in the width direction.

By naturally cooling the rail without insulation, there may not be a need to perform selection of an insulating material, and there need be no capital expenditure on insulation materials. Further, it is possible to shorten the time required in cooling in comparison to a process which includes insulation.

Further, by naturally cooling the rail without performing accelerated cooling, it is more difficult for foreign structures to develop within the metal structure than in an accelerated cooling operation, and therefore, the metal properties after cooling are stable.

In addition, as it is possible to reduce the curvature of the rail when cooling it to ambient temperature, it is possible to prevent in advance any problems such as imbalance and toppling during the subsequent transport operations.

According to still another exemplary embodiment of the rail manufacturing method according to the present invention, by mechanically restricting the foot of the rail as well as maintaining it in an upright state until the surface temperature of the head of the rail reaches the 800° C. to 400° C. temperature range, the straightness of the rail can be maintained through stress due to the heat expansion and contraction differential which is generated by the temperature gradient between the head and foot of the rail, and therefore, it is possible to control the curvature of the rail in the vertical direction. As a result, it is possible to prevent curvature of the rail in the vertical direction without needing to perform deformation operations in advance to prevent conventional bending.

BRIEF DESCRIPTION OF THE DRAWINGS

Further objects, features and advantages of the invention will become apparent from the following detailed description taken in conjunction with the accompanying figure(s) showing illustrative embodiment(s), result(s) and/or feature(s) of the exemplary embodiment(s) of the present invention, in which.

DETAILED DESCRIPTION OF EXEMPLARY EMBODIMENTS OF INVENTION

Figure 1:
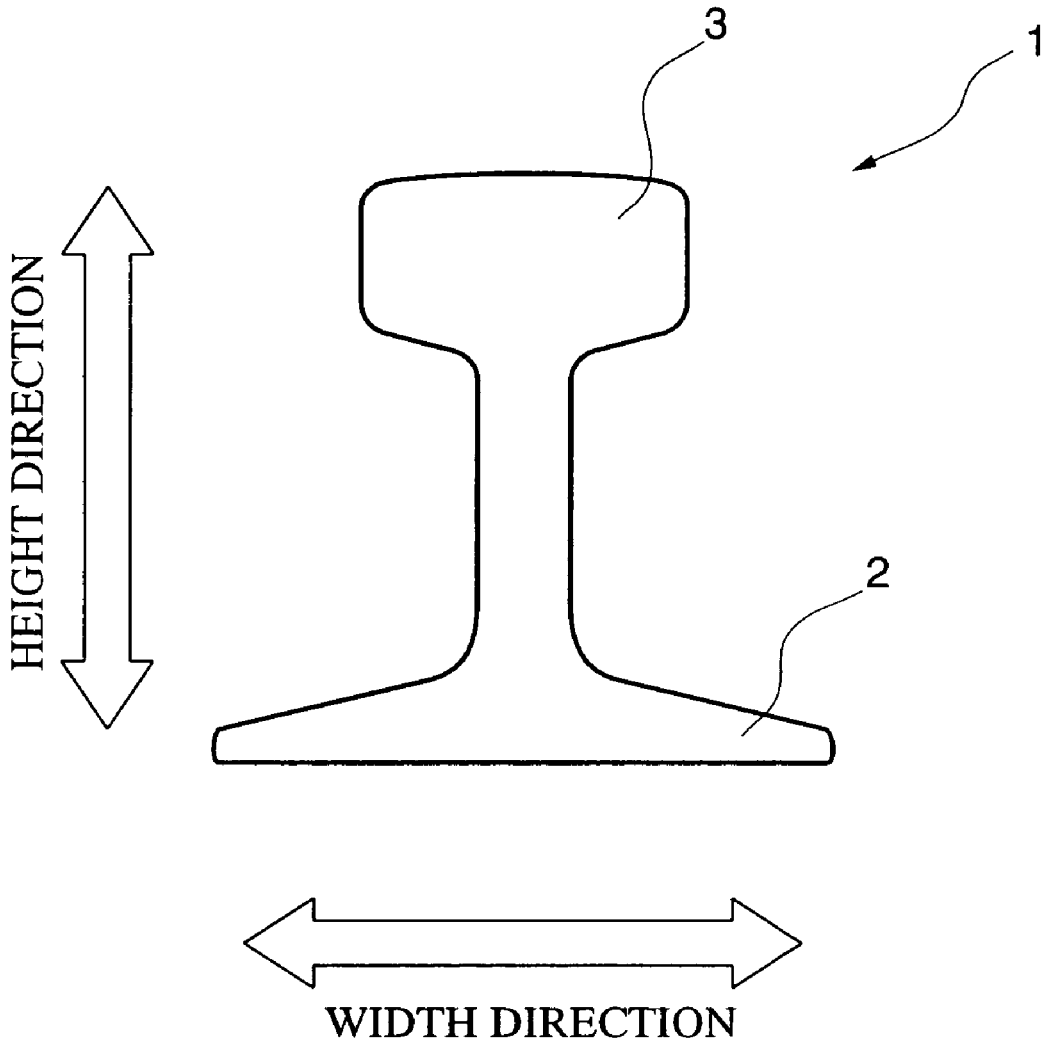
FIG. 1 is illustrates a cross-sectional view of a rail in an upright state to be cooled according to an exemplary embodiment of the present invention.

As shown in FIG. 1, while the shape of the foot 2 of the rail 1 for use in a railroad is plate-like and spreading in the lateral direction, the head 3 is clumped, and as a result, during cooling of the high temperature rail after hot-rolling, the cooling of the foot 2 will proceed faster than will that of the head 3. Therefore, corresponding to the fall in temperature, the rail 1 that is left on the cooling bed will likely, after the end of the rail 1 bends towards the foot side 2, finally bend in the head direction 3 (bending in the height direction). Further, when cooling the rail 1 on its side, rail 1 may bend in the width direction due to the difference in cooling speed of the side which is in contact with the cooling bed and the side which is left exposed, as well as due to the properties and structure of the cooling bed.

As the result of studying methods to prevent the generation of curvature on the cooling bed, the present inventors found that it is effective to naturally cool the rail 1 without insulation or accelerated cooling while maintaining the rail 1 in an upright state until the surface temperature of the head part 3 of the rail 1 reaches the 400° C. to 250° C. temperature range. As a result, it is possible to obtain the effects of curvature rectification on bending in the height direction from the weight of the rail itself, as well as to obtain the effects of curvature rectification in terms of bending in the width direction by approximately equalizing the cooling speeds of both sides of the rail 1, and therefore, it is possible to improve the straightness of the rail 1 as a result.

The reason for selecting the natural cooling temperature without insulation or accelerated cooling while maintaining the rail 1 in an upright state and for allowing the surface temperature of the head part 3 of the rail 1 to reach the 400° C. to 250° C. temperature range is as follows. In the temperature range above 250° C., as the stress according to the thermal expansion and contraction differential of the strength of the steel will decrease, by changing the position of the rail 1 or by performing accelerated cooling using water, a thermal expansion and contraction differential is generated due to the temperature difference between the head part 3 and the foot part 2, and therefore, curvature will be generated in the steel which has been stress-softened at high temperature.

Therefore, it may be preferable to perform natural cooling in this temperature range without insulating the rail 1 or cooling it in an accelerated manner. However, in the temperature range below 250° C., since the strength of the steel will increase along with the stress accompanying the thermal expansion and contraction differential, even if the position of the rail 1 is changed or if accelerated cooling is performed with water, no bending will occur in the steel. When the relationship with the heat treatment discussed below is also considered, rail 1 is put into an upright state after hot-rolling, and thereafter processing is performed while maintaining that state until ambient temperature is reached, so this is also preferable in terms of the configuration of the manufacturing equipment.

Further, in the temperature range above 400° C., even if the carbon steel rail 1 is cooled in an accelerated manner or insulated, no undesirable metal structures such as martensite will be generated. However, in the temperature range below 400° C., if the carbon steel rail 1 is cooled in an accelerated manner or insulated, it is possible for metal structures, such as martensite, that would be undesirable in a railroad rail to be generated. Therefore, it may be preferable, in this temperature range, for the cooling be performed naturally, with no insulation or accelerated cooling of the rail 1.

Based on the above reasons, by keeping the rail 1 in an upright state until the surface temperature of the head part 3 of the rail 1 reaches the 400° C. to 250° C. temperature range, it is possible to control the curvature in the height direction by the weight of the rail itself. Further, by keeping the rail 1 in an upright state, neither the right side nor the left side of the rail 1 comes into contact with the cooling bed, and heat is dissipated from both sides in the same way, so there is no temperature gradient in the width direction of the rail 1, and it is possible to control curvature in the width direction. It goes without saying that it is effective to keep the rail 1 in an upright state from temperature ranges higher than this.

In the cooling operation at this point, it is important that there be no insulation or accelerated cooling. If no insulation is performed, there is no need to select an insulation material, and there need be no capital expenditure on insulation materials. Further, it is possible to shorten the cooling period in comparison to a process which includes insulation. Also, when comparing processes which include and which do not include accelerated cooling, in the case where forcible cooling is not performed, it is more difficult to foreign structures to be generated within the metal structure, and therefore, the metal properties are stable after cooling.

In order to maintain the rail 1 in an upright state and to ensure that it does not topple onto the cooling bed, in addition to maintaining the rail 1 in an upright state, the foot part 2 of the rail 1 must be mechanically restrained until the temperature of the rail 1 after hot-rolling reaches a temperature range where plastic deformation is likely, in other words, until the surface temperature of the head part 3 of the rail 1 falls to the region of 800° C. to 400° C.

By mechanically restraining the foot part 2 of the rail 1 in this way, it is more difficult to large curvature to be generated in the stage prior to natural cooling, and therefore, it is more difficult for the rail 1 to topple over even in an upright state.

It may be even more effective to cool the head part 3 and the foot part 2 of the rail 1 in an accelerated manner at a speed of 1° C. per second to 20° C. per second while maintaining the rail 1 in an upright state and mechanically restraining the foot part 2 of the rail 1 until the temperature of each part of the rail 1 reaches a temperature range where the structure of the rail 1 begins to change, in other words, until the surface temperature of the head part reaches the 550° C. to 450° C. temperature range and until the surface temperature of the foot part 2 of the rail 1 reaches the 500° C. to 450° C. temperature range. By cooling the rail 1 in an accelerated manner in the above conditions, it is possible to control curvature generated when the metal structure begins to deform, and therefore, the straightness of the rail 1 is increased. Here, the selection of the cooling speed to be 1 to 20° C. per second is due to the fact that, in comparison to a natural cooling process of less than 1° C. per second, there is not only little noticeable difference in efficacy, but also, at a speed of greater than 20° C. per second, there is more likely to be a temperature anomaly due to differences in region, which can lead to difficulties in adjustment of the temperature for halting the accelerated cooling operation.

In such case, if there is no heat treatment performed on the rail 1, the rail 1 can be naturally cooled after hot-rolling until it reaches the above temperatures. When performing heat treatment, it is preferable to perform accelerated cooling of the rail 1 at a cooling speed of 1 to 20° C. per second from the temperature range where the metal structure is austenitic. By making the temperature range where accelerated cooling is performed to be 450° C., it is possible to simultaneously control curvature of the rail 1. As the method of accelerated cooling, it is possible to use a conventional method such as, for example, the method where air or water mist is blown onto the rail, or the method where the rail is immersed in water or oil.

The apparatus which restrains the foot part 3 of the rail 1 is, as previously described in combination with heat treatment apparatus for rail 1. For example, it is possible to use a restraining apparatus as described in Japanese Unexamined Patent Application Publication 2003-160813.

It may also be effective to set the length of the rail 1 during cooling to be a certain length or more. By setting the length of the rail to be a certain length on the cooling bed, constraining effects from the weight of the rail are generated, and it is possible to more effectively control the curvature of the rail 1.

The length of the rail shipped within Japan is generally 25 meters, and while it is common to cut the rail to this length in the cooling process to cool it, by cooling an even longer rail in an upright state, it is possible to enjoy the controlling effects of the weight of the rail on the curvature. The most preferable length is greater than or equal to 80 meters. According to an exemplary embodiment of the present invention, there is no need to establish an upper limit on the length of the rail 1, but in terms of the rail manufacture facilities overall, the length will be limited due to handling constraints. In the present invention, it is possible to set the upper limit of the length to be less than or equal to 250 meters.

The cooling bed used in the exemplary embodiment of the present invention can be the same as the conventional prior art structure. Conventional cooling beds feature conveyers for transport as well as water facilities to increase the cooling speed after cooling the rail to below 200° C., but there is no need for rectification apparatus as described in Japanese Unexamined Patent Application Publication H05-076921 and Japanese Unexamined Patent Application Publication H09-168814 or for insulation equipment for the cooling bed as described in Japanese Unexamined Patent Application Publication S59-031824.

As described above, according to the rail manufacturing method of the exemplary embodiment of the present invention, by keeping the rail in an upright state for the period when the surface temperature of the rail is falling from 400° C. to 250° C., it is possible to control the bending in the vertical direction due to the weight of the rail itself. Further, as the heat is dissipated from both sides of the rail approximately equally and there will be no temperature difference in the width direction of the rail 1, it is possible to control the bending in the width direction of the rail. Therefore, it is possible to prevent curvature of the rail in the vertical direction without needing to perform conventional deformation operations in advance to prevent bending.

According to the exemplary embodiment of the present invention, as no deformation operations are performed in advance to prevent bending, the spinning machine which changes the direction of the rail likely needs only to be a single unit in the process following the hot-rolling. Therefore, it is possible to not only reduce capital costs but to also reduce the scale of the equipment footprint for the cooling apparatus. Further, as the area of the cooling bed when the rail is upright will be smaller than the area of the cooling bed when the rail is positioned laterally, it is possible to increase the number of rails to be cooled at a single time, thereby increasing productivity, and to reduce the scale of the equipment footprint while maintaining productivity.

In addition, by putting the rail into an upright state after hot-rolling, it is possible to incorporate measurement of the cross-sectional shape dimensions during conveyance, so simplification of hot shape sample extraction becomes possible. Shape samples are mainly extracted by measuring the respective portions of the rail cross section offline when cutting after hot-rolling, and they are used to adjust the subsequent pressure conditions of hot-rolling of the material, but because the cutting locations are limited by the length of the product, and the line is stopped while the product is cut, drops in production efficiency were caused.

In the case in which online cross-sectional shape dimensional measurement is put into place, in the conventional method of lateral conveyance, the amount of curvature during conveyance was extremely large, so the shape gauge had to be made large to match that size. In addition, it was not possible to obtain sufficient accuracy. Therefore, by conveying the rail in an upright state as in the present invention and further reducing the amount of curvature in advance, highly accurate measurement is made possible, and, in addition, measurement of any position on the entire length of the rail becomes possible. Also, by using these measurement results in the correction adjustments performed after ambient temperature cooling, it is possible to further increase the straightness of the rail.

The cross-sectional shape dimension gauge is placed at the beginning of conveyance, preferably while heading toward the cooling floor, and measurement is performed along with rail movement. For the shape of the dimension gauge, it is possible to apply a well-known apparatus, for example, a system in which a rod is brought into contact and the displacement is measured, or a system in which the distance is measured by light, such as a laser.

Example of Variant 1

JIS (Japanese Industrial Standards) 50 kg N rails which were cut into lengths of 25 meters, 50 meters, 100 meters, and 150 meters following the hot-rolling operation was divided into groups of 20 rails for each length. Then, all of the rails were laid onto their sides, and were left (natural cooling) until the surface temperature of the head part of the rail reached 400° C. Afterwards, all of the rails were stood upright, and were left while the surface temperature of the head part of the rail dropped from 400° C. to 250° C. Then, keeping half of the rails within each group in an upright state, the remaining half of the rails were positioned laterally and were left to cool to ambient temperature on a concrete bed (cooling bed). After the cooling operation was complete, the number of rails which had toppled over was counted and measurements were taken on the degree of curvature of each rail in the height direction as well as in the width direction (all curvature in the upwards direction).

For the degree of curvature in the height direction, the distance between both ends of the rail and the bed in the upright state was measured, and sought the average value for both measurements. Further, the degree of curvature in the width direction in the same manner was measured, and the average value determined. The results are shown in Table 1.

TABLE 1

| | Length during cooling | Position during cooling | Number of fallen rails | Curvature in the height direction (mm) | Curvature in the width direction (mm) | Comments |
|---|---|---|---|---|---|---|
| 1 | 25 | Upright | None | 750 | 65 | This invention |
| 2 | " | Lateral | — | 770 | 65 | Comparative Example |
| 3 | 50 | Upright | None | 760 | 120 | This invention |
| 4 | " | Lateral | — | 780 | 120 | Comparative Example |
| 5 | 100 | Upright | None | 780 | 240 | This invention |
| 6 | " | Lateral | — | 800 | 240 | Comparative Example |
| 7 | 150 | Upright | None | 780 | 380 | This invention |
| 8 | " | Lateral | — | 800 | 380 | Comparative Example |

Further, as a comparison with the above Example of Variant 1, JIS 50 kg N rails which were cut into lengths of 25 meters, 50 meters, 100 meters, and 150 meters following the hot-rolling operation were divided into groups of 20 rails for each length. Then, all of the rails were laid onto their sides, and were left (natural cooling) until the surface temperature of the head part of the rail reached 400° C. Afterwards, all of the rails were kept in the lateral position, and were left until the surface temperature of the head part of the rail reduced from 400° C. to 250° C. Then, setting half of the rails within each group in an upright state, the remaining half of the rails were kept in a lateral position and were left to cool to ambient temperature on a concrete cooling bed. After the cooling operation was complete, the number of rails which had toppled over was counted and measurements were taken on the degree of curvature of each rail in the height direction as well as in the width direction in the same method as before. The results are shown in Table 2.

TABLE 2

| | Length during cooling | Position during cooling | Number of fallen rails | Curvature in the height direction (mm) | Curvature in the width direction (mm) | Comments |
|---|---|---|---|---|---|---|
| 1 | 25 | Upright | All | 780 | 85 | Comparative Example |
| 2 | " | Lateral | — | 800 | 85 | Comparative Example |
| 3 | 50 | Upright | All | 830 | 150 | Comparative Example |
| 4 | " | Lateral | — | 850 | 150 | Comparative Example |
| 5 | 100 | Upright | All | 880 | 300 | Comparative Example |
| 6 | " | Lateral | — | 900 | 300 | Comparative Example |

TABLE 2-continued

| | Length during cooling | Position during cooling | Number of fallen rails | Curvature in the height direction (mm) | Curvature in the width direction (mm) | Comments |
|---|---|---|---|---|---|---|
| 7 | 150 | Upright | All | 880 | 500 | Comparative Example |
| 8 | " | Lateral | — | 900 | 500 | Comparative Example |

As shown in the above Tables 1 and 2, according to the present invention, it is possible to reduce the amount of curvature in both the height and width directions of the rail as well as to maintain the rails in an upright state even during cooling.

Example of Variant 2

JIS 60 kg rails which were cut into lengths of 150 meters following the hot-rolling operation were divided into groups of 20 rails each. Then, all of the rails were stood upright, and were forcibly cooled by blowing air onto them until the surface temperature of the head part of the rail fell from 800° C. to 450° C. The accelerated cooling speed was set to 0° C. per second, 1° C. per second, 3° C. per second, 5° C. per second and 10° C. per second, using a different accelerated cooling speed for each group. Further, restraining the foot part of half of the rails in each group using a clamp apparatus, the foot part of the remainder of the rails was left unrestrained. Afterwards, all of the rails were kept in an upright position and were cooled to ambient temperature. After the cooling operation was complete, measurements were taken on the degree of curvature of each rail in the height direction as well as in the width direction in the same method as in the above Example of Variant 1. The results are shown in Table 3.

TABLE 3

| | Accelerated cooling speed (° C./s) | Restraint during accelerated cooling | Curvature in the height direction (mm) | Curvature in the width direction (mm) | Comments |
|---|---|---|---|---|---|
| 1 | None | No | 650 | 190 | Comparative Example |
| 2 | " | Yes | 450 | 120 | This invention |
| 3 | 1 | No | 500 | 210 | Comparative Example |
| 4 | " | Yes | 210 | 120 | This invention |
| 5 | 3 | No | 440 | 210 | Comparative Example |
| 6 | " | Yes | 150 | 120 | This invention |
| 7 | 5 | No | 400 | 220 | Comparative Example |
| 8 | " | Yes | 140 | 120 | This invention |
| 9 | 10 | No | 370 | 220 | Comparative Example |
| 10 | " | Yes | 140 | 120 | This invention |

As shown in Table 3, according to this invention, by restraining the rail in an upright position during cooling, it was possible to reduce the degree of curvature after cooling to ambient temperature.

Above, the favorable embodiments and examples of embodiment of the present invention has been described, but the present invention is not limited to these embodiments and examples of embodiment. It is possible for additions, omissions, replacements and other modifications to be made to the structure without deviating from the purpose of this invention. In addition, all references, publications and patent applications referenced above are incorporated here by reference in their entireties.

POSSIBILITY OF INDUSTRIAL APPLICATION

The present invention relates to a rail manufacturing method for hot-rolling a billet into a rail shape and then after hot-rolling cooling the high-temperature rail to ambient temperature. The present invention also relates to a rail manufacturing method, in which the rail is maintained in an upright state until the surface temperature of the foot of the rail reaches the 400° C. to 250° C. temperature range, and the rail is cooled naturally without using insulation or accelerated cooling. According to the present invention, it is possible to prevent curvature of the rail in the vertical direction without needing to perform conventional deformation operations in advance to prevent bending.

The invention claimed is:

1. A rail manufacturing method, comprising:

a) hot-rolling a billet into a form of a rail having a high temperature;

b) maintaining the rail on a cooling bed in an upright position without a use of both (i) an insulation and (ii) an accelerated cooling procedure, and naturally cooling the rail when a surface temperature of a head of the rail is in a temperature range of approximately 400° C. to approximately 250° C.; and c) before procedure (b), maintaining the rail on the cooling bed in an upright position and mechanically restraining a foot of the rail when the surface temperature of the head of the rail is in a temperature range of approximately 800° C. to approximately 400° C., wherein the curvature of the rail in a vertical direction can be controlled through a weight of the rail.

2. A rail manufacturing method, comprising:

a) hot-rolling a billet into a form of a rail having a high temperature;

b) maintaining the rail on a cooling bed in an upright position without a use of both (i) an insulation and (ii) an accelerated cooling procedure, and naturally cooling the rail when a surface temperature of a head of the rail is in a temperature range of approximately 400° C. to approximately 250° C.; and c) before procedure (b), accelerated cooling the head and a foot of the rail in an upright position until (i) the surface temperature of the head of the rail reaches a temperature range of approximately 550° C. to 450° C., or (ii) a surface temperature of the foot of the rail reaches a temperature range of approximately 550° C. to 450° C. at a speed of substantially 1° C. per second to 20° C. per second while the foot of the rail is mechanically restrained on the cooling bed by a clamping apparatus, wherein the curvature of the rail in a vertical direction can be controlled through a weight of the rail.

3. The rail manufacturing method according to claim 2, in procedure (c) wherein one of the surface temperature of the head of the rail which begins the accelerated cooling and the surface temperature of the foot part of the rail which begins the accelerated cooling is the temperature at which a structure of the rail is austenitic.

4. The rail manufacturing method according to claim 1, wherein, after procedure (b), maintaining the rail in the upright position until an ambient temperature is reached.

5. The rail manufacturing method according to claim 4, wherein a cross-sectional shape of the rail is measured online during a conveyance of the rail that has been placed into the upright position after procedure (a).

6. The rail manufacturing method according to claim 1, wherein a length of the rail is between substantially 80 meters and 250 meters.

7. The rail manufacturing method according to claim 2, wherein, after procedure (b), maintaining the rail in the upright position until an ambient temperature is reached.

8. The rail manufacturing method according to claim 7, wherein a cross-sectional shape of the rail is measured online during a conveyance of the rail that has been placed into the upright position after procedure (a).

9. The rail manufacturing method according to claim 2, wherein a length of the rail is between substantially 80 meters and 250 meters.

* * * * *

UNITED STATES PATENT AND TRADEMARK OFFICE

CERTIFICATE OF CORRECTION

PATENT NO. : 7,828,917 B2
APPLICATION NO. : 10/585472
DATED : November 9, 2010
INVENTOR(S) : Noriaki Onodera et al.

It is certified that error appears in the above-identified patent and that said Letters Patent is hereby corrected as shown below:

In "Assignee"

Reads
"Nippon Steel Corporation, Chiyoda-ku, Yokyo (JP)"

Should Read
"Nippon Steel Corporation, Chiyoda-ku, Tokyo (JP)"

Signed and Sealed this
Second Day of August, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,828,917 B2
APPLICATION NO. : 10/585472
DATED : November 9, 2010
INVENTOR(S) : Noriaki Onodera et al.

It is certified that error appears in the above-identified patent and that said Letters Patent is hereby corrected as shown below:

Title Page, Item (73) Assignee

Reads
"Nippon Steel Corporation, Chiyoda-ku, Yokyo (JP)"

Should Read
"Nippon Steel Corporation, Chiyoda-ku, Tokyo (JP)"

This certificate supersedes the Certificate of Correction issued August 2, 2011.

Signed and Sealed this
Twenty-third Day of August, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,828,917 B2
APPLICATION NO. : 10/585472
DATED : November 9, 2010
INVENTOR(S) : Noriaki Onodera et al.

It is certified that error appears in the above-identified patent and that said Letters Patent is hereby corrected as shown below:

Title Page, Item (30) insert

-- Foreign Application Priority Data

Jan. 9, 2004 (JP) .....2004-004358 --

Signed and Sealed this
Eleventh Day of October, 2011

David J. Kappos

David J. Kappos
*Director of the United States Patent and Trademark Office*